US005106254A

United States Patent [19]

Tolasch et al.

[11] Patent Number: 5,106,254

[45] Date of Patent: Apr. 21, 1992

[54] APPARATUS FOR FILLING AND EMPTYING TRAYS FOR ROD-SHAPED ARTICLES OF THE TOBACCO PROCESSING INDUSTRY

[75] Inventors: Gerhard Tolasch; Horst Bäse, both of Wentorf, Fed. Rep. of Germany

[73] Assignee: Körber AG, Hamburg, Fed. Rep. of Germany

[21] Appl. No.: 553,880

[22] Filed: Jul. 16, 1990

[30] Foreign Application Priority Data

Jul. 20, 1989 [DE] Fed. Rep. of Germany ..... 3924098

[51] Int. Cl.[5] ..... A24C 5/352

[52] U.S. Cl. ..... 414/418; 414/403

[58] Field of Search ..... 414/403, 413, 418, 419, 414/421, 422; 198/347.1, 347.4

[56] References Cited

U.S. PATENT DOCUMENTS

| | | | |
|---|---|---|---|
| 3,519,143 | 7/1970 | Kochalski . | |
| 3,598,268 | 8/1971 | Wallace | 414/413 |
| 3,610,448 | 10/1971 | Bornfleth . | |
| 3,655,080 | 4/1972 | Gianese | 414/403 X |
| 3,679,079 | 7/1972 | Seragnoli | 414/403 |
| 3,703,242 | 11/1972 | Marradi | 414/403 X |
| 3,774,791 | 11/1973 | Bornfleth | 414/403 X |
| 3,777,911 | 12/1973 | Bornfleth . | |
| 4,099,637 | 7/1978 | Molins | 414/413 |
| 4,112,651 | 9/1978 | Bardenhagen . | |
| 4,278,385 | 7/1981 | Bardenhagen | 414/419 |
| 4,319,861 | 3/1982 | Seragnoli | 414/419 |
| 4,507,040 | 3/1985 | Baese | 414/403 |
| 4,564,329 | 1/1986 | Bantien | 414/403 |
| 4,690,604 | 9/1987 | Calverley et al. | 414/403 |
| 4,747,743 | 5/1988 | Dowding et al. | 414/403 |
| 4,892,453 | 1/1990 | Bantien | 414/403 |
| 4,995,769 | 2/1991 | Berger et al. | 198/347.1 X |

FOREIGN PATENT DOCUMENTS

| | | | |
|---|---|---|---|
| 2718125 | 11/1978 | Fed. Rep. of Germany | 198/347.1 |
| 2800570 | 7/1979 | Fed. Rep. of Germany | 198/347.4 |
| 2072119 | 9/1981 | United Kingdom | 414/403 |

*Primary Examiner*—David A. Bucci
*Assistant Examiner*—Robert S. Katz
*Attorney, Agent, or Firm*—Peter K. Kontler

[57] ABSTRACT

Apparatus for removing filter cigarettes from a mass flow between one or more producing machines and one or more processing machines when the output of the producing machines exceeds the requirements of the processing machines, and for returning filter cigarettes into the mass flow when the requirements of the processing machines exceed the output of the producing machines, has a filling unit which withdraws cigarettes from the mass flow and introduces them into successive empty chargers or trays, and an emptying unit which dumps the contents of filled trays into a receptacle for reintroduction into the mass flow. The emptying unit is located at a level above the filling unit, and each of these units cooperates with two magazines, one for empty trays and the other for filled trays. The four magazines are adjacent and parallel to each other, the magazines for empty trays are disposed at a first level above the respective magazines for filled trays, the magazines for filled trays are disposed at a common second level, and the magazines which supply trays to and receive trays from the filling unit are immediately adjacent such unit. The apparatus further employs two linear conveyors one of which transfers empty trays between the magazines for empty trays and the other of which transfers filled trays between the magazines for filled trays, elevators for filled and empty trays, and a turn-around device for filled trays which are on their way to the emptying unit and for empty trays which are on their way from the emptying unit.

8 Claims, 5 Drawing Sheets

4
37
34
4
46
8
36'
43
44
34
11
36
4
9
33
11
34
26

APPARATUS FOR FILLING AND EMPTYING TRAYS FOR ROD-SHAPED ARTICLES OF THE TOBACCO PROCESSING INDUSTRY

BACKGROUND OF THE INVENTION

The invention relates to improvements in apparatus for manipulating containers, for example, for manipulating so-called chargers or trays which are utilized for temporary storage of rod-shaped articles of the tobacco processing industry.

Rod-shaped articles of the tobacco processing industry which can be treated in the apparatus of the present invention include filter rod sections, filter cigarettes, filter cigars, filter cigarillos and others, especially rod-shaped articles which do not consist of mirror symmetrical halves. For example, a filter cigarette has a filter mouthpiece or filter plug at one end, a filter rod can carry an imprint closer to one end than to the other, a filter cigar comprises a mouthpiece or filter at one end, and the same holds true for filter cigarillos. The following description of the state of prior art and of the invention will deal primarily with the manipulation of containers for temporary confinement of filter cigarettes; however, it is to be understood that the improved apparatus can be employed with equal advantage for manipulation of containers which are used for temporary storage of many other types of rod-shaped articles of the tobacco processing industry.

It is well known to employ a so-called container-filling unit which is adjacent the path of a mass flow of filter cigarettes advancing from a filter tipping machine to a packing machine or another processing or consuming machine. The filling unit transfers the surplus of filter cigarettes from the mass flow into a series of empty containers of the type known as chargers or trays when the output of one or more producing machines (e.g., filter tipping machines) exceeds the requirements of the consuming or processing machine or machines (e.g., packing machines). Filled containers are stored, and their contents are returned into the mass flow when the requirements of the consuming or processing machine or machines exceed the output of the making machine or machines. The means for returning filter cigarettes from filled containers into the mass flow comprises a so-called container-evacuating unit, for example, a unit which can dump the contents of filled containers into a duct or another receptacle whence the filter cigarettes are admitted into the mass flow or are used to form a mass flow if the producing machine or machines are at a standstill.

It is further known to temporarily store filter rod sections which are to be converted into filter mouthpieces or filter plugs. Temporary storage is often desirable or necessary in order to ensure that certain substances (e.g., triacetin) which are used to partially bond the filaments of a filter rod section to each other are adequately cured before the filter rod sections are subdivided into filter mouthpieces or filter plugs which are ready for attachment to plain cigarettes in a filter tipping machine.

The container-filling unit is normally combined or associated with a magazine for storage of empty containers and with a magazine for storage of filled containers, and such magazines are or can be disposed at different levels. Analogously, the container-evacuating unit is or can be combined or associated with a magazine for empty containers and with a magazine for filled containers, and the these two magazines are or can be located at different levels. Still further, an apparatus which employs a container-filling unit and a container-emptying or evacuating unit comprises a device which transports emptied containers from the corresponding magazine for the container-emptying unit to the other magazine for empty containers, i.e., to that magazine from which empty containers are drawn to be filled with filter cigarettes by the container-filling unit.

Direct coupling of one or more producing machines with one or more consuming or processing machines for filter cigarettes continues to gain popularity in the tobacco processing industry. However, and since it is not always possible to operate each producing machine and/or each consuming or processing machine at full or normal speed, it is necessary to provide apparatus for temporary storage of surplus filter cigarettes when one or more consuming or processing machines are idle or operate at less than maximum speed, and for delivery of filter cigarettes from storage to the consuming machine or machines when the requirements of such machines exceed the output of the producing machine or machines. Containers for temporary storage of the surplus of filter cigarettes are circulated along an endless path, namely from the empty-container magazine which is associated with the container-filling unit, through the filling unit and into the magazine for storage of filled containers coming from the filling unit, from the magazine for storage of filled containers coming from the filling unit to the magazine which serves to store filled containers prior to emptying in the container-emptying unit, to the emptying unit, to the magazine which receives containers from the emptying unit, and from the last named magazine to the magazine which is associated with the filling unit and serves to store empty containers.

As a rule, the container-emptying unit includes a device which dumps the contents of successive filled containers in such a way that the orientation of filter cigarettes is changed by 180°. Therefore, it is necessary to change the orientation of dumped filter cigarettes before they reenter the mass flow on their way from the maker or makers to the consuming or processing machine or machines. This can be accomplished by changing the orientation of filled containers prior to the dumping step so that the change of orientation which is caused as a result of dumping the contents of filled containers results in renewed reorientation of filter cigarettes, namely in renewed reorientation which ensures that the dumped articles are ready for reintroduction into the mass flow in such a way that their orientation matches that of articles which advance directly from the maker or makers to the consuming or processing machine or machines. Freshly emptied containers are reoriented prior to returning into the corresponding magazine for the container-filling unit or not later than at the time of entering the filling unit.

OBJECTS OF THE INVENTION

An object of the invention is to provide an apparatus which can manipulate a large number of filled and empty containers in a small area.

Another object of the invention is to provide an apparatus wherein the containers must be transported through short distances to and from the container-filling unit as well as to and from the container-emptying or evacuating unit.

A further object of the invention is to provide an apparatus which can be used as a reservoir between one or more machines for mass production of rod-shaped articles of the tobacco processing industry and one or more processing or consuming machines.

An additional object of the invention is to provide an apparatus which treats the articles gently and which can store large numbers of rod-shaped articles for selected intervals of time in a small area.

A further object of the invention is to provide an apparatus wherein all units and/or other components are readily accessible from two or more sides for convenient inspection, repair or adjustment.

Still another object of the invention is to provide novel and improved means for transferring empty and filled containers between various magazines for such containers.

An additional object of the invention is to provide a novel and improved array of magazine which can store empty and filled containers in an apparatus of the above outlined character.

Another object of the invention is to provide a novel arrangement of modules which together constitute the above outlined apparatus and to shorten the paths for containers which are circulated in the apparatus.

A further object of the invention is to provide an apparatus which can be installed in existing production lines for filter rod sections, filter cigarettes or other rod-shaped articles of the tobacco processing industry as a superior substitute for heretofore known receptacles or buffers for rod-shaped articles which necessitate temporary storage due to failure of consuming or processing machines, in order to provide time for curing of certain ingredients or constituents and/or for other reasons.

SUMMARY OF THE INVENTION

The invention is embodied in an apparatus for manipulating empty and filled containers (for example, the so-called chargers or trays) for rod-shaped articles (e.g., filter cigarettes) of the tobacco processing industry. The improved apparatus comprises a container-filling first unit having means for converting successive empty containers into filled containers (for example, by drawing surplus articles from a mass flow between one or more producing machines and one or more processing or consuming machines), and a container-emptying second unit having means (e.g., a dumping device) for converting successive filled containers into empty containers (the contents of filled containers can be admitted into a duct or a like device which can transport or discharge the articles back into the mass flow or to another destination). One of these units is disposed at a level above the other unit and the apparatus further comprises a first magazine having means (e.g., one or more endless belt or chain conveyors) for temporarily storing containers which are about to be filled by the first unit, a second magazine having means for temporarily storing containers which are already filled with rod-shaped articles, a third magazine having means for temporarily storing containers which are already emptied, and a fourth magazine having means for temporarily storing containers which are about to be emptied by the second unit. The magazines are adjacent and at least substantially parallel to each other.

The second unit can be located at a level above the first unit, the first and second magazines can be disposed one above the other adjacent or immediately adjacent the first unit, and the third and fourth magazines are or can be spaced apart from the second unit. The arrangement is preferably such that the third magazine is adjacent and is disposed at the level of the first magazine, and that the fourth magazine is adjacent and is disposed at the level of the second magazine.

The apparatus preferably further comprises means for transferring containers from the third magazine into the first magazine and means for transferring containers from the second to the fourth magazine. Each such transferring means can include a conveyor having means (e.g., pushers) for advancing containers along a substantially straight path, particularly along a horizontal path because the first and third magazines are preferably located at a first level and the second and fourth magazines are preferably located at a second level different from (particularly below) the first level.

The apparatus preferably further comprises a turnaround device having means for moving containers between the second unit on the one hand and the third or fourth magazine on the other hand and for simultaneously changing the orientation of containers. The combined moving and orientation changing means can include means for turning containers through angles of 180°, particularly along a substantially horizontal arcuate path about a substantially vertical axis. The moving means can be designed to move and reorient containers at a level above the magazines, and the apparatus can further comprise means for lifting containers from the fourth magazine to the moving means and means for moving containers between the moving means, the third magazine and the second unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
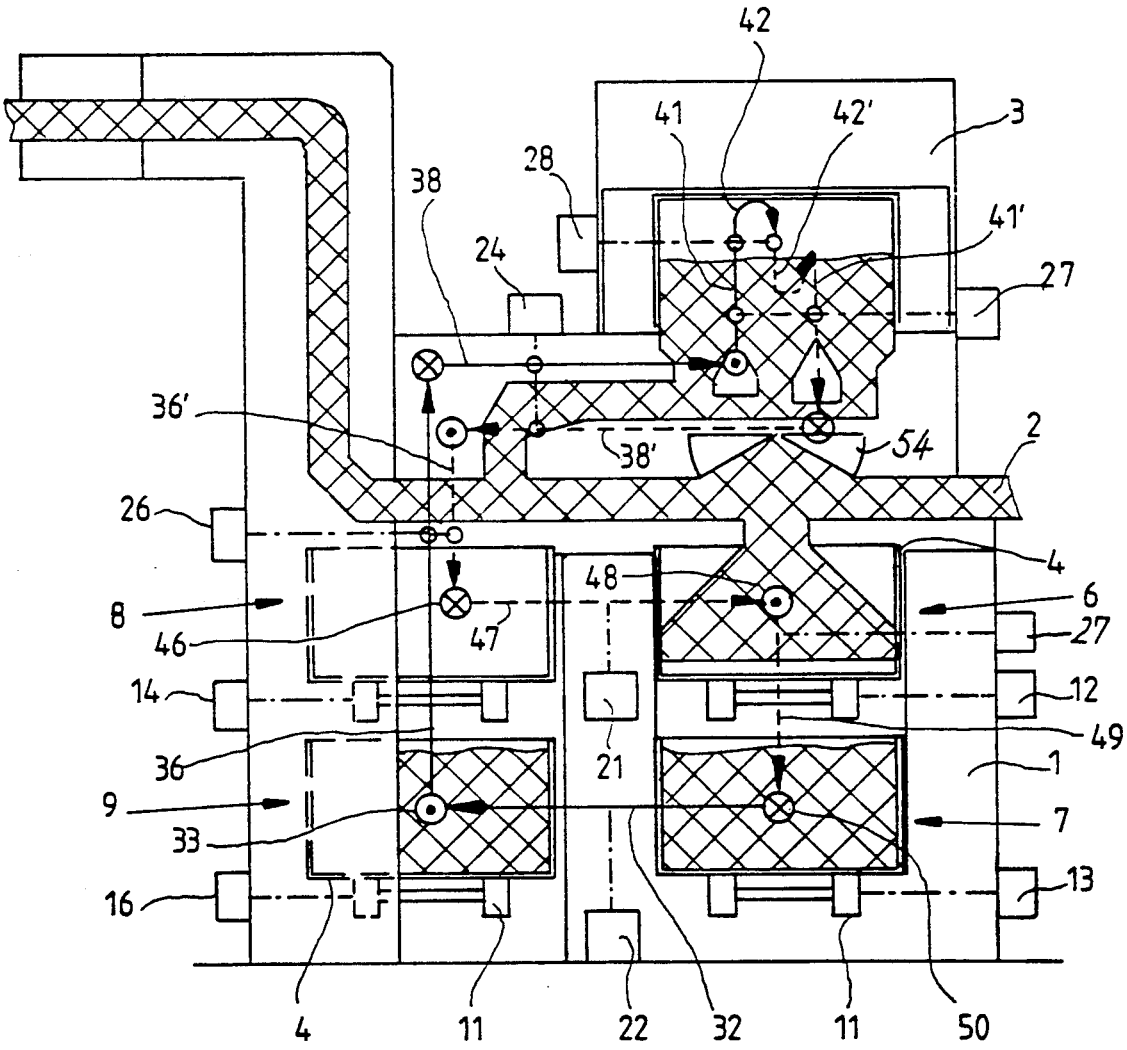
FIG. 1 is a schematic front elevational view of an apparatus which embodies one form of the invention showing the container filling unit at a level below the container-emptying unit, the first and third magazines at a first level next to each other, and the second and fourth magazines next to each other at a second level below the first level.

The apparatus which is shown in FIG. 1 comprises a container-filling unit 1, a container-evacuating or emptying unit 3 at a level above the filling unit 1, and four magazines, namely magazines 6, 8 for storage of empty containers 4 and magazines 7, 9 for storage of filled containers 4. The purpose of the filling unit 1 is to transfer filter cigarettes 29 (FIGS. 3, 4 and 5) into successive empty containers 4 which are withdrawn from the magazine 6, and the thus filled containers 4 are temporarily stored in the magazine 7. The unit 1 draws filter cigarettes 29 from a mass flow 2 of parallel filter cigarettes. The mass flow 2 advances along a predetermined path from one or more makers (such as filter tipping machines of the type known as MAX which are produced by the assignee of the present application) to one or more consuming or processing machines, e.g., to one or more cigarette packing machines of the type described and shown, for example, in commonly owned Bardenhagen et al. U.S. Pat. No. 4,112,651. If the articles 29 are filter rod sections which require temporary storage in a reservoir, e.g., a reservoir of the type known as RESY which is produced by the assignee of the present application, they can be temporarily stored in containers 4 on their way from the filter rod making machine to the reservoir or from the reservoir to a filter tipping machine.

Filter cigarettes 29 must be withdrawn from the mass flow 2 when the output of the maker or makers exceeds the requirements of the processing or consuming machine or machines in a production line, e.g., because one or more consuming or processing machines are slowed down or are brought to a full stop.

When the requirements of the consuming or processing machine or machines exceed the output of the maker or makers, filled containers 4 must be emptied and their contents must be reintroduced into the mass flow 2 in order to ensure that the producing or consuming machine or machines need not be slowed down or arrested as a result of temporary stoppage or temporary slowing down of one or more makers. To this, end, the magazine 9 receives filled containers from the magazine 7, the contents of successive filled containers 4 coming from the magazine 9 are evacuated by the unit 3, and the thus emptied containers 4 are introduced into the magazine 8 prior to being returned into the magazine 6 to thus complete the cycle.

In accordance with one feature of the invention, and as already mentioned above, the unit 3 is located at a level above the unit 1. In accordance with another feature of the invention, the four magazines 6 to 9 are parallel and adjacent each other, the magazines 6, 8 for empty containers 4 are located at a first level, the magazines 7, 9 for filled containers 4 are located at a second level below the magazines 6, 8, the magazines 6, 8 are respectively located above the magazines 7, 9, the magazines 6, 8 are closely or immediately adjacent the filling unit 1, and the magazines 8, 9 are spaced apart from the emptying unit 3. Furthermore, the magazines 6, 8 at the upper level are immediately or closely adjacent each other, and the magazines 7, 9 at the lower level are also immediately or closely adjacent each other.

Each magazine has means for temporarily storing empty or filled containers 4, and such storing means comprises pairs of endless chain or belt conveyors 11 which are shown in FIGS. 1 and 3 to 5. The drive means for the pair of conveyors 11 forming part of the magazine 6 is shown at 12, the drive means for the pair of conveyors 11 forming part of the magazine 7 is shown at 13, the drive means for the pair of conveyors 11 forming part of the magazine 8 is shown at 14, and the drive means for the pair of conveyors 11 forming part of the magazine 9 is shown at 16 (see FIG. 1).

Figure 3:
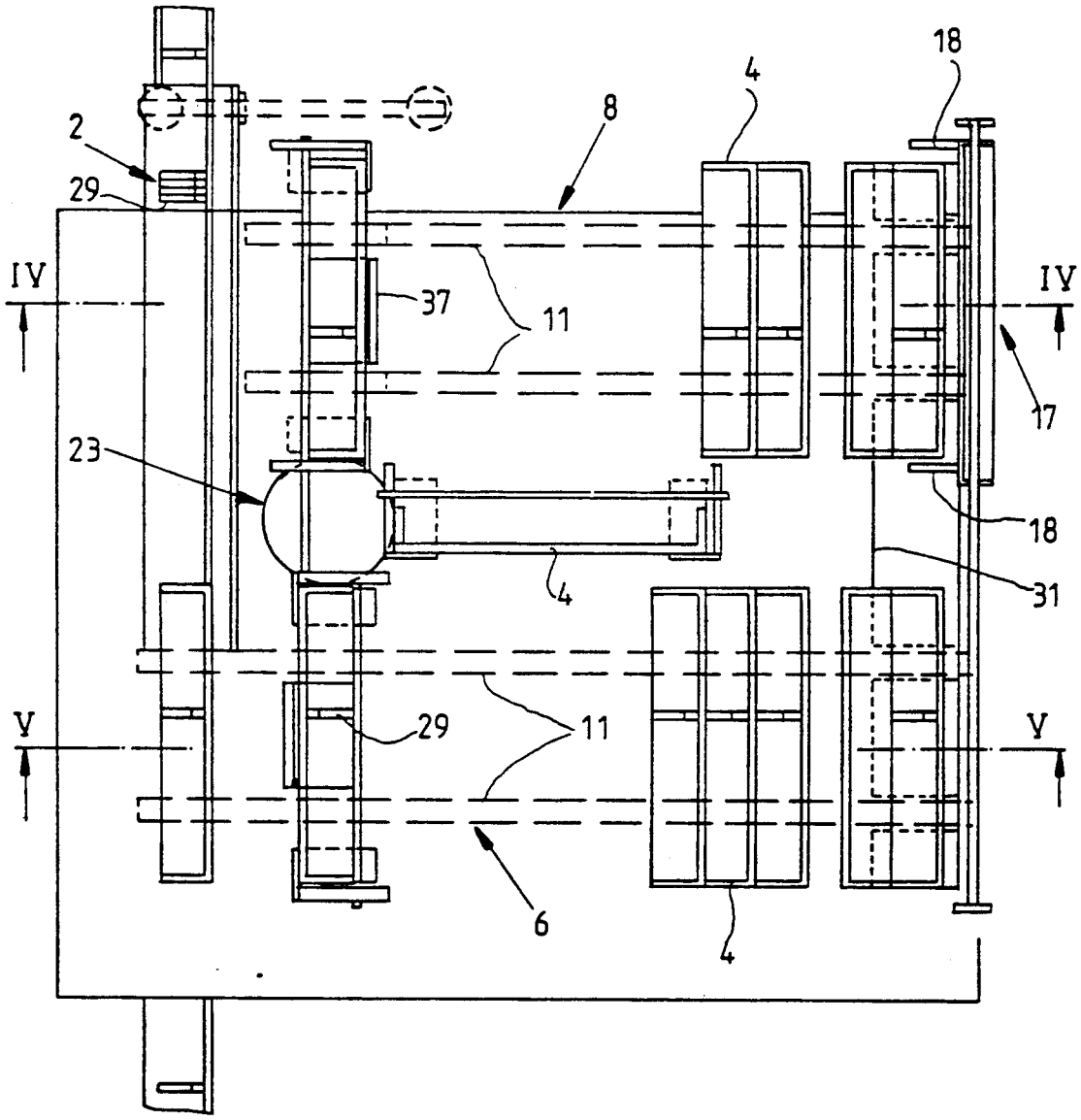
FIG. 3 is a schematic plan view of the apparatus of FIG. 1.
Figure 4:
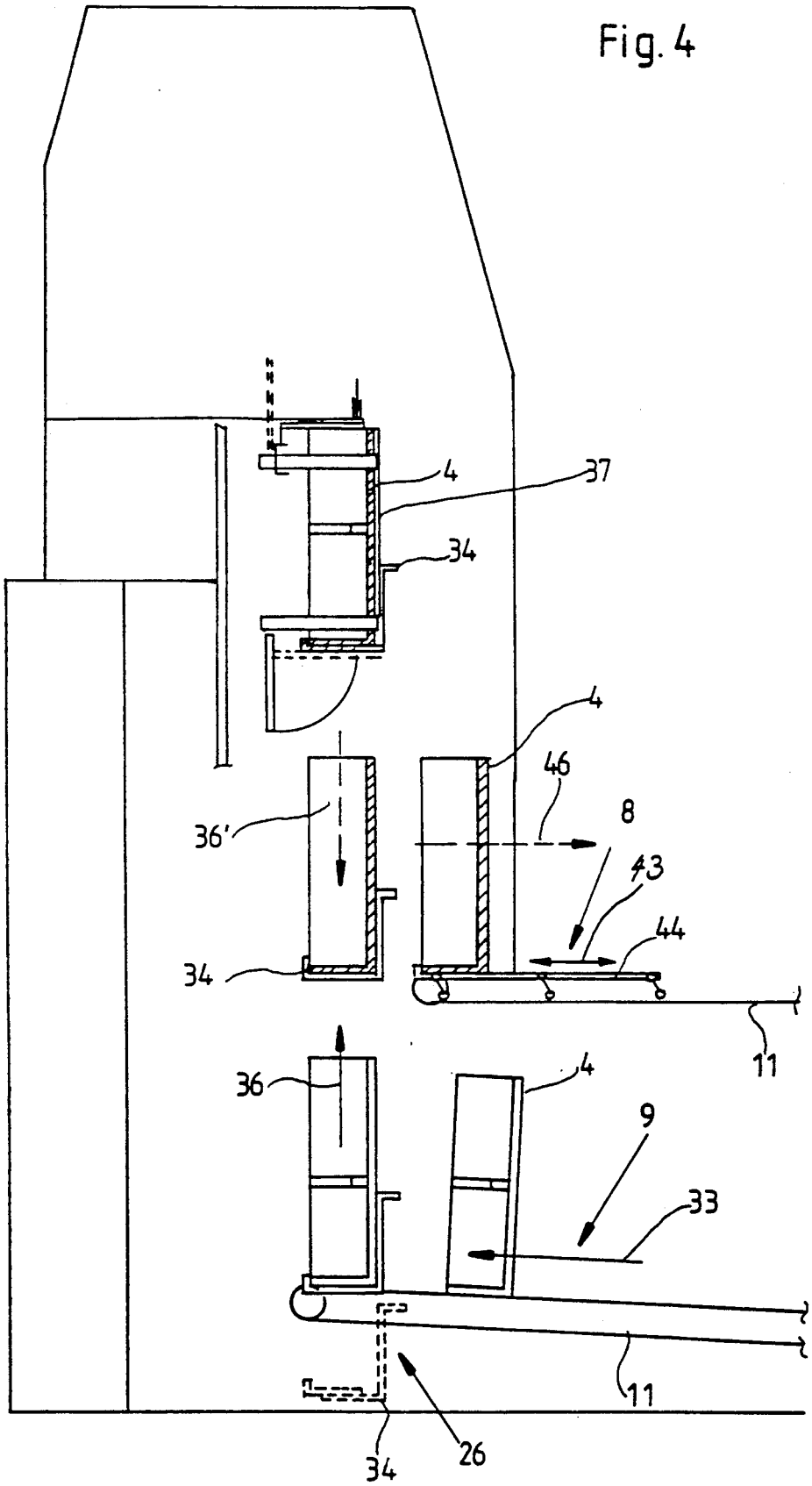
FIG. 4 is a schematic vertical sectional view substantially as seen in the direction of arrows from the line IV—IV of FIG. 3.

The apparatus further comprises means for transferring empty containers 4 between the magazines 6, 8 and means for transferring filled containers 4 between the magazines 7, 9. Each of these transferring means comprises a so-called linear conveyor 17 with means (pushers 18 shown in FIGS. 3 and 5) for advancing containers 4 along a substantially straight horizontal path. The containers 4 which are shown in the drawing are so-called chargers or trays of the type normally employed for temporary storage of rod-shaped articles of the tobacco processing industry. Each such container normally comprises a bottom wall, a rear wall and two sidewalls. The pushers 18 are designed to engage the sidewalls of containers 4 and to move the thus engaged containers at right angles to the plane of FIG. 5, i.e., up or down as seen in FIG. 3 and from the left to the right or vice versa as seen in FIG. 1. Each of the linear conveyors 17 further comprises one or more sets of rollers 19 (FIG. 5) which guide the carriers of pushers 18 on their way along the respective straight horizontal paths. The drive means for the carrier of pushers 18 forming part of the upper linear conveyor 17 (between the magazines 6 and 8) is shown in FIG. 1, as at 21, and the drive means for the carrier of pushers 18 forming part of the lower linear conveyor 17 is shown at 22.

Still further, the apparatus comprises a turn-around device 23 (see particularly FIG. 3) which is disposed at a level above the magazines 6, 8 and beneath the emptying unit 3. The purpose of the turn-around device 23 is to change the orientation of filled containers 4 on their way from the magazine 9 to the unit 3 and to change the orientation of empty containers 4 on their way from the unit 3 to the magazine 8. The turn-around device 23 comprises a drive 24 (FIG. 1) which moves a filled container 4 or an empty container 4 along an arcuate horizontal path about a substantially vertical axis.

The apparatus also comprises a first elevator 26 which serves to lift filled containers 4 from the magazine 9 into the range of the turn-around device 23, and a second elevator 27 which serves to raise reoriented filled containers from the turn-around device to the unit 3 and to lower empty containers 4 from the unit 3 to the turn-around device 23. The unit 3 comprises a drive 28 which can turn successive reoriented filled containers 4 upside down (see the upper portion of FIG. 5) so that the filter cigarettes 29 are dumped into a duct or receptacle 54 (FIG. 1) beneath the freshly inverted left-hand container 4 in the unit 3. The receptacle 54 has means for returning filter cigarettes 29 into the mass flow 2 for advancement toward the consuming or processing machine or machines.

Solid-line arrows are utilized to denote the directions of movement of filled containers 4, and broken-line arrows are employed to denote the directions of movement of empty containers. Dots within circles are used to denote the direction of movement of containers 4 toward, and encircled characters x are employed to denote the direction of movement of containers away from, the observer of FIG. 1.

Figure 5:
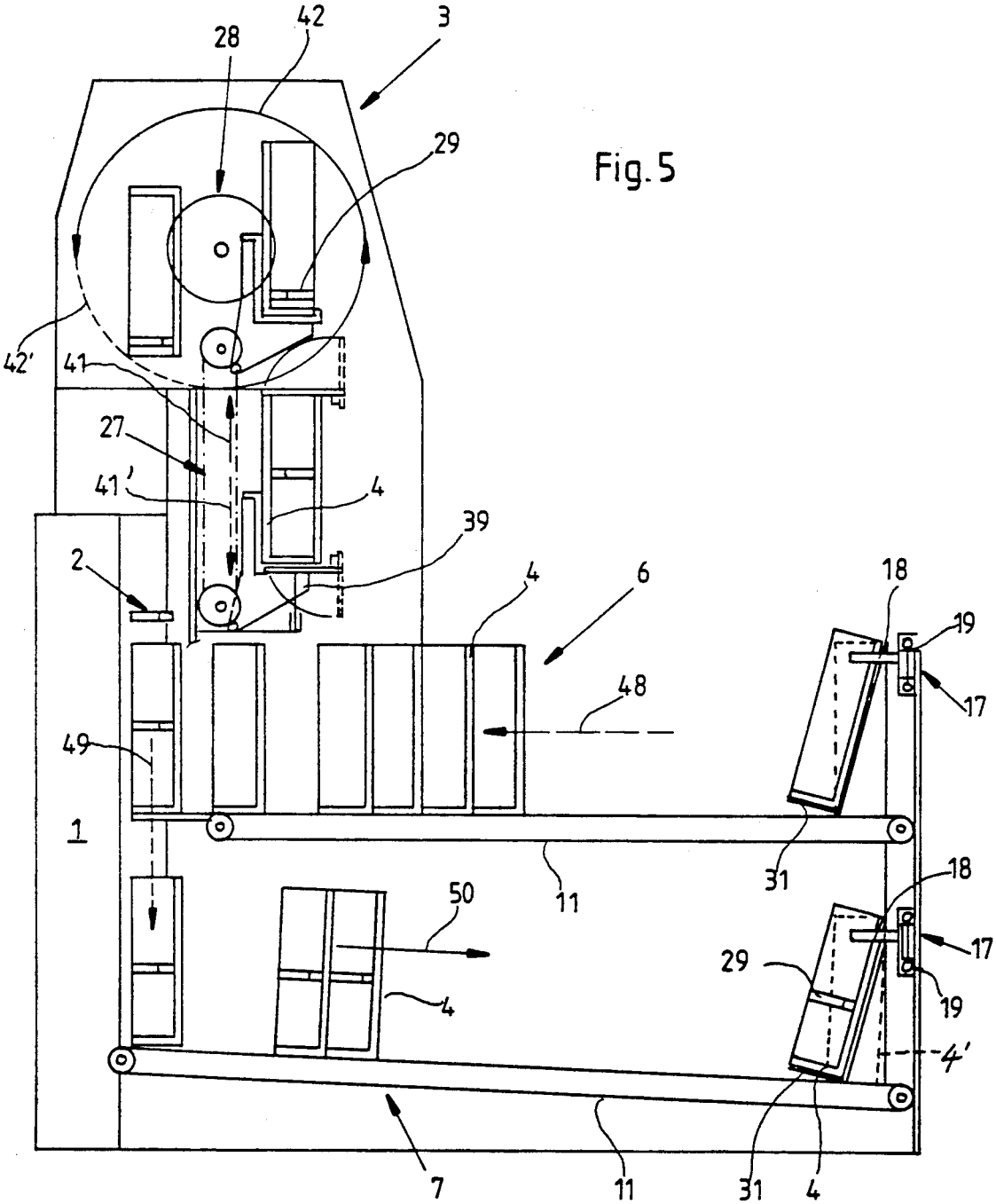
FIG. 5 is a schematic vertical sectional view substantially as seen in the direction of arrows from the line V—V of FIG. 3.

The unit 1 fills successive empty containers 4 (which are supplied by the conveyors 11 of the magazine 6) when the output of the maker or makers exceeds the requirements of the consuming or processing machine or machines, and the conveyors 11 of the magazine 7 advance successive filled containers 4 from the unit 1 in a direction to the right, as seen in FIG. 5. The arrow 48 denotes the direction of intermittent or continuous advancement of empty containers 4 from the upper linear conveyor 17 of FIG. 5 toward the unit 1, and the arrow 50 denotes the direction of intermittent or continuous advancement of filled containers 4 from the unit 1 toward the lower linear conveyor 17. When the rightmost filled container 4 on the conveyors 11 of the magazine 7 reaches the lower linear conveyor 17, it is located on a pivotable platform 31 (FIG. 5) which forms part of the conveyor 17 and is tilted so that the rightmost filled container is lifted off the respective conveyors 11 and its rear and bottom walls are inclined in a direction to prevent, or to at least reduce, the likelihood of escape of confined filter cigarettes 29 by way of the open front side. The position of the rightmost filled container 4 in the magazine 7 prior to tilting by the platform 31 is indicated in FIG. 5 by broken lines, as at 4'. The drive means 22 for the carriers of pushers 18 forming part of the lower linear conveyor 17 is then set in motion to advance (arrow 32) the filled container 4 on the platform 31 from the magazine 7 into the adjacent magazine 9 for the container-emptying unit 3. The filled container 4 is advanced by a pusher 18 of the lower linear conveyor 17 which engages one sidewall of the tilted container to move the latter upwardly, as seen in FIG. 3.

If the magazine 9 is empty, the respective conveyors 11 accept the freshly delivered filled container 4 from the platform 31 of the lower linear conveyor 17 and advance the container in the direction of arrow 33 (FIGS. 2 and 4), namely from the lower conveyor 17 to the elevator 26. The filled tray 4 is accepted by a carrier 34 of the elevator 26 and is lifted in the direction of arrow 36 to enter a carrier 37 (FIG. 3) of the turn-around device 23 at a level above the magazine 8 for empty containers. The device 23 changes the orientation of the filled container 4 in or on the carrier 37 and of filter cigarettes 29 in such container by 180° (arrow 38 in FIGS. 1 and 2). The thus reoriented filled container 4 is then in the range of a carrier 39 forming part of the elevator 27 which is set in motion to lift the filled container (arrow 41 in FIGS. 1 and 2) above the turn-around device 23 and into the range of the drive 28 which is designed to move containers in a vertical plane and along a path which is indicated by the arrow 42 shown in FIGS. 1 and 2. The drive 28 inverts the filled container 4 so that the filter cigarettes 29 are introduced into the receptacle 54 to be reintroduced into the mass flow 2. The orientation of filter cigarettes 29 which reenter the mass flow 2 is the same as that of filter cigarettes advancing directly from the maker or makers to the consuming or processing machine or machines.

The freshly emptied container 4 is advanced by the drive 28 in the direction of arrow 42' (FIGS. 1 and 2) to reenter the range of the elevator 27 which moves the empty container downwardly (arrow 41') onto the carrier 37 of the turn-around device 23. The latter moves the empty container 4 along the arcuate horizontal path (arrow 38' in FIGS. 1 and 2) so that the empty container reassumes its original orientation (the same as that in the magazine 6, 7 or 9). The reoriented empty container 4 is accepted by the carrier 34 of the elevator 26 which moves it downwardly (arrow 36') toward the conveyors 11 forming part of the magazine 8. It is desirable to provide a carriage or slide 44 (shown in FIG. 4) which is reciprocable in directions indicated by double-headed arrow 43) and serves to transfer empty containers 4 from the elevator 26 onto the conveyors 11 of the magazine 8. The turn-around device 23 is then ready to receive a filled container 4 from the elevator 26 which receives the filled container from the magazine 9 and lifts it in the direction of arrow 36. Such filled container moves upwardly along and past the magazine 8.

Figure 2:
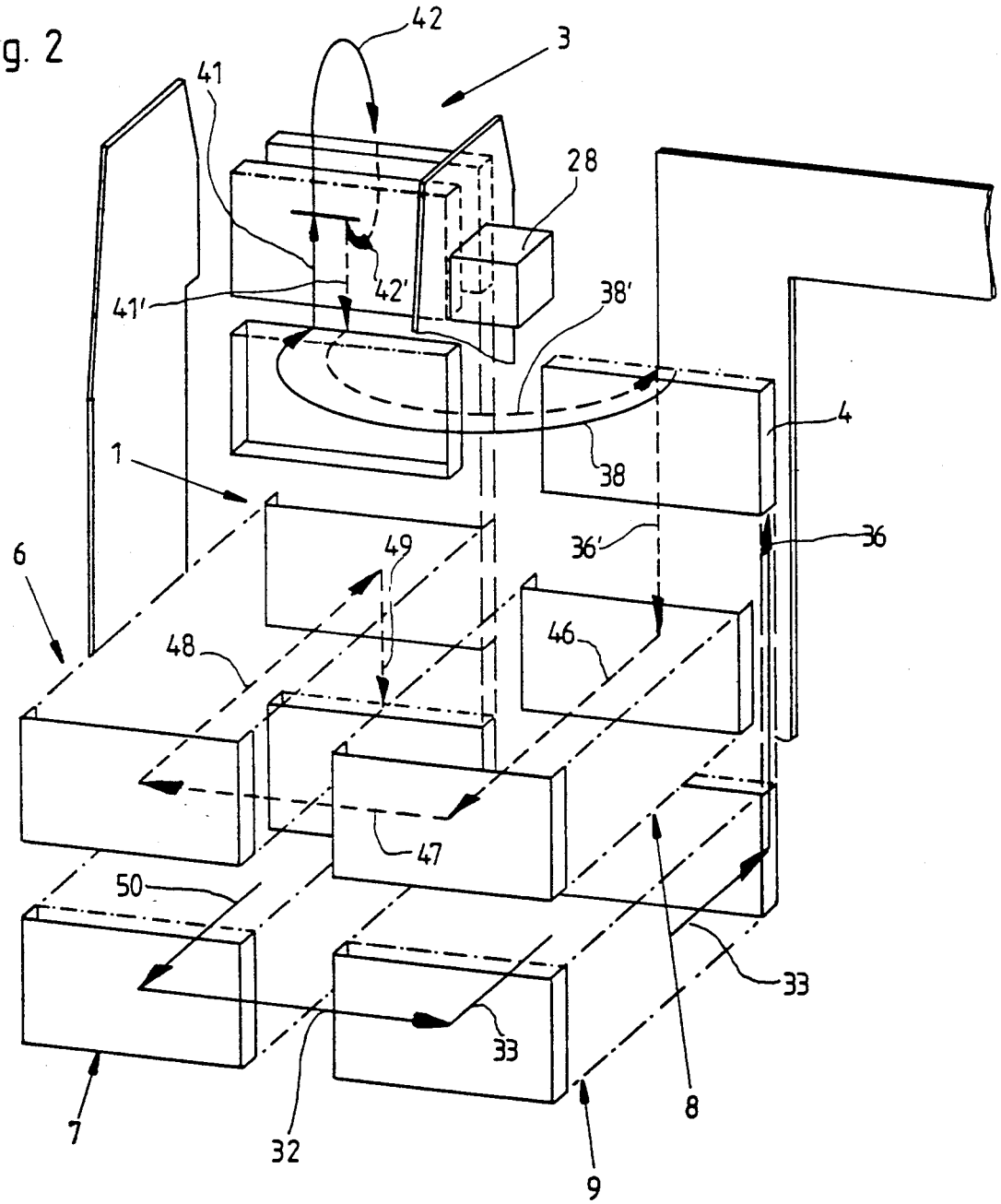
FIG. 2 is a fragmentary schematic rear perspective view of the apparatus which is shown in FIG. 1.

An empty container 4 which has been delivered by the carriage 44 and rests on the conveyors 11 of the magazine 8 is advanced in the direction of arrow 46, namely toward the right-hand end of the magazine 8 (as seen in FIG. 3) and into the range of the upper linear conveyor 17 which moves the empty container in the direction of arrow 47 to deposit it on the conveyors 11 of the magazine 6. These conveyors advance the empty container 4 in the direction of arrow 48 (FIGS. 1, 2 and 5) into the unit 1 which fills the container with filter cigarettes 29. Filling of the container 4 with filter cigarettes 29 can involve stepwise downward movement of the container in the direction of arrow 49 (FIGS. 1, 2 and 5). Reference may be had to Kochalski et al. U.S. Pat. No. 3,519,143 which shows the manner of filling chargers or trays with cigarettes or other rod-shaped articles of the tobacco processing industry. The freshly filled container 4 is deposited on the conveyors 11 of the magazine 7 which move the container in the direction of arrow 50, i.e., back into the range of the lower linear conveyor 17. This completes the cycle and constitutes the start of a fresh cycle which involves a movement of the filled container 4 with the lower conveyor 17, in the magazine 9, with the elevator 26, turn-around device 23 and elevator 27 into the range of the drive 28 forming part of the container-emptying unit 3, with the elevator 27, turn-around device 23 and elevator 26 to the carriage 44, through the magazine 8, with the upper linear conveyor 17 into the magazine 6, through the magazine 6 to the unit 1, and through the magazine 7 back to the lower linear conveyor 17.

An important advantage of the improved apparatus is that it occupies a small amount of floor space because the magazines 6 to 9 are parallel and immediately adjacent each other, because the magazines 6, 8 are located above the respective magazines 7, 9, because the magazines 6, 7 are immediately adjacent the filling unit 1, and because the emptying unit 3 is located at a level above the unit 1 and above the magazines 6, 8.

Another important advantage of the improved apparatus is that its units 1, 3, its elevators 26, 27, its turn-around device 23, its linear conveyors 17, its carriage 44 and its endless conveyors 11 are readily accessible for inspection, adjustment, repair or replacement. The linear conveyors 17 render it possible to transfer empty containers 4 from the magazine 8 into the magazine 6 along the shortest possible path, and to transfer filled containers 4 from the magazine 7 into the magazine 9 along the shortest possible path.

The turn-around device 23 ensures that the orientation of filter cigarettes 29 in the receptacle 54 is satisfactory for reintroduction into the mass flow 2. This device changes the orientation of successive filled containers 4 on their way toward the emptying unit 3 and the orientation of successive empty containers 4 on their way from the unit 3.

A further important advantage of the improved apparatus is that its output is high even if the containers 4 are not transported at an elevated speed. This is due to the fact that the paths along which the (filled and empty) containers must move are short or extremely short, i.e., the output is relatively high even if the containers are moved at a low speed. This, in turn, ensures that the filter cigarettes are treated gently, especially since the various drives are preferably designed to ensure gradual acceleration and deceleration of the respective conveyors, elevators and other moving parts. Gradual acceleration and deceleration and the operation of moving parts at relatively low speeds greatly reduce the likelihood of malfunction.

Apparatus which are somewhat similar to the apparatus of the present invention are described and shown in commonly owned copending patent application Ser. No. 525,078 of Glössmann et al. and in commonly owned Bantien et al. U.S. Pat. Nos. 4,892,453, 4,564,329, Bäse et al. U.S. Pat. No. 4,507,040, Bornfleth U.S. Pat. No. 3,610,448 , Bardenhagen et al. U.S. Pat. No. 4,278,385 and Bornfleth U.S. Pat. No. 3,777,911.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating empty and filled containers for rod-shaped articles of the tobacco processing industry, comprising a container-filling first unit having means for converting successive empty containers into filled containers; a container-emptying second unit having means for converting successive filled containers into empty containers, said second unit being disposed at a level above said first unit; a first magazine having means for temporarily storing containers which are to be filled by said first unit; a second magazine having means for temporarily storing containers already filled by said first unit, said first and second magazines being respectively disposed at first and second levels one above the other and being directly connected to said first unit; a third magazine having means for temporarily storing containers already emptied by said second unit; a fourth magazine having means for temporary storage of containers to be emptied by said second unit, said magazines being substantially parallel to each other, one of said third and fourth magazines being adjacent and being disposed at the level of one of said first and second magazines and the other of said third and fourth magazines being adjacent and being disposed at the level of the other of said first and second magazines; and a turn-around device having means for moving containers between said second unit on the one hand and the third or fourth magazine on the other hand and for simultaneously changing the orientation of containers, said means for changing the orientation of containers including means for turning the containers through angles of 180° and said turning means including means for moving the containers along a substantially horizontal arcuate path about a substantially vertical axis.

2. The apparatus of claim 1, wherein said third and fourth magazines are spaced apart from said second unit.

3. The apparatus of claim 1, further comprising means for transferring containers from said third magazines to said first magazine.

4. The apparatus of claim 3, wherein said first and third magazines are disposed at the same level.

5. The apparatus of claim 1, further comprising means for transferring containers from said second to said fourth magazine.

6. The apparatus of claim 1, wherein said second and fourth magazines are disposed at said second level and said first and third magazines are disposed at said first level.

7. The apparatus of claim 6, further comprising means for transferring containers between said first and third magazines, said transferring means including a conveyor having means for advancing containers along a substantially straight path.

8. The apparatus of claim 1, wherein said moving means is operative to move containers at a level above said magazines and further comprising means for lifting containers from said fourth magazine to said moving means and means for raising or lowering containers between said moving means, said second unit and said third magazine.

* * * * *